US005403014A

United States Patent [19]

Anema et al.

[11] Patent Number: 5,403,014

[45] Date of Patent: Apr. 4, 1995

[54] GAME AND METHOD OF PLAY

[76] Inventors: Dale A. Anema; Roxane J. Anema, both of 6365 W. Frost Dr., Littleton, Colo. 80123

[21] Appl. No.: 306,406

[22] Filed: Sep. 15, 1994

[51] Int. Cl.[6] ..... A63F 1/10

[52] U.S. Cl. ..... 273/292; 273/148 A; 434/348

[58] Field of Search ..... 273/236, 281, 283, 287, 273/292, 289, 148 A, 273; 434/348, 333, 405; 40/492

[56] References Cited

U.S. PATENT DOCUMENTS

| | | | |
|---|---|---|---|
| 3,097,435 | 7/1963 | Goldschmidt | 434/348 |
| 3,110,499 | 11/1963 | Boeskool | 434/348 X |
| 3,224,112 | 12/1965 | Hanson | 434/348 |
| 3,347,549 | 10/1967 | Jackson | 273/273 |
| 4,089,527 | 5/1978 | Roth | 273/273 X |
| 4,829,686 | 5/1989 | Endicott | 40/492 |
| 5,288,075 | 2/1994 | Kelley | 273/243 |

*Primary Examiner*—William E. Stoll
*Attorney, Agent, or Firm*—Michael A. Capraro

[57] ABSTRACT

A game having a card viewing device played by a plurality of players or teams of players. The game provides a plurality of multi-dimensional challenges that test player knowledge and reasoning, a player responding to a challenge in a pre-determined length of time. The game provides a card viewing device, a plurality of category game cards, a plurality of acronym game cards, at least one die, a timing device, a plurality of score indicating devices of varying color or shape where each color or shape corresponds to a challenge category and a plurality of score indicating holding devices. An initiating player is determined by the roll of at least one die. The die is rolled again by the initiating player to determine the nature of the challenge. The challenge may be to guess a question, guess an answer or plurality of answers, or the player's may choose the challenge depending on the die roll. Also a player may lose his or her turn depending on the die roll. Category game cards and acronym game cards provide the challenge information. The game cards are viewed in a new and novel card viewing device which has a plurality of movable elongated shielding members covering a transparent window member. The game cards are inserted into the card viewing device and the appropriate elongated shielding member is opened to reveal the challenge information on the game card which can be seen through the transparent window member. A player who successfully meets a challenge earns a score indicating means of the appropriate color or shape which is placed in the player's score indicator holding device. The first player to earn two score indicators means for each challenge category is declared the winner. Also disclosed is a novel method of playing the game.

20 Claims, 7 Drawing Sheets

GAME AND METHOD OF PLAY

BACKGROUND OF THE INVENTION

This invention relates generally to games and more specifically to a new and novel parlor game and method of playing the game. The new and novel game and method is designed to test player knowledge and reasoning in a wide variety of areas or categories of knowledge, each area or category of knowledge having various sub-categories.

While there are games that test player knowledge and other games that test player reasoning, these games are one dimensional in that they test player knowledge only or reasoning only by posing similarly structured challenges throughout the game playing time or session. Thus, once a player determines the nature of the challenges presented, the challenges lose their appeal and effectiveness and the player can easily become dissatisfied or impatient with the game play. Additionally, after a player has played these types of games a number of times and repeatedly faced the same challenge, the player becomes so familiar with the challenges presented, at times to the point of having memorized the challenge and its appropriate response, that the game loses its excitement and appeal.

Another problem encountered with games of this type occurs when several players are involved in the game session and the player who first encounters a game challenge fails to meet that particular challenge. In this instance, the other players may not be afforded an opportunity to meet the challenge, or, if other players are afforded the opportunity to meet the challenge, the player who is allowed to meet the challenge is determined by a complex set of rules.

SUMMARY OF THE INVENTION

To overcome the before described considerations and problems inherent in and encountered with prior art games, there is provided by the subject invention a unique game having a new and novel card viewing device and method of play that challenges both knowledge and reasoning of individual or team players. The new and novel game and method provides multi-dimensional challenges to the player in a variety of areas or categories of knowledge. The nature of the challenges provided by applicant's new and novel game and the skills required to meet those challenges vary throughout the game play thereby maintaining player interest and excitement over the course of one or several game sessions.

To achieve the foregoing and other advantages, the present invention provides a new and novel game designed to be played by two or more players or teams of players and has a plurality of game cards including category cards and acronym cards, at least one card viewing device, at least one die, a plurality of score indicating means, a plurality of score indicating means holding devices and at least one timer. A scratch pad and pencil are also provided.

The plurality of game cards have a name side and an opposing challenge information side. Each side bears indicia thereon. There are two types of game cards: category game cards and acronym game cards. The name side of the category game cards bear indicia indicating the category or area of knowledge to be challenged. The challenge information side of the category game cards bear indicia providing information about the particular category or area of knowledge to be challenged as well as providing information which forms a basis for that challenge. There are five categories of category game cards, each category having a plurality of game cards available for use during a game session. The information provided on the challenge side of a category game card includes a sub-category of the category, a question, a plurality of answers to the question, the total number of answers possible and the minimum number of answers acceptable for guess answer play as will be discussed more fully hereinafter.

The indicia representing the question and answers on the challenge side of the plurality of category game cards are a color other than black or white. A plurality of masking characters of the corresponding complementary color is over-laid on the appropriate indicia representing the question and answers on the challenge side of the plurality of category game cards. Thus, when viewed with the naked eye, the challenge information on the plurality of category game cards cannot be read. However, the challenge information can be read when the category game card is placed in the card viewing device as will be discussed more fully hereinafter. In another embodiment, masked challenge information may be located on both sides of the category game cards thereby reducing the total number of category game cards without reducing the number of challenges.

Also, in a another embodiment the indicia representing the question and answers on the challenge information side of a game card does not have masking characters over-laying the indicia. However, greater care must be exercised by players to prevent any player from viewing the indicia before a game card is placed into the card viewing device.

The plurality of acronym game cards have a title side and an opposing challenge information side. Each side bears indicia thereon. The title side of the acronym game cards bear indicia indicating the game card is an acronym game card. The challenge information side of the acronym game cards bear indicia providing information about a particular acronym which forms a basis for that challenge. In another embodiment, challenge information may be located on both sides of the acronym game cards thereby reducing the total number of acronym game cards without reducing the number of challenges. In this embodiment, players would draw an acronym game card from the bottom of a pile of acronym game cards thus preventing any player from seeing the challenge information prior to play on the selected acronym game card.

The new and novel card viewing device provided with applicant's game is constructed of a lightweight semi-rigid material and is further constructed having a card receiving area, a viewing side, a plurality of movable elongated shielding members including a movable elongated question shielding member and a plurality of movable elongated answer shielding members, and a transparent window member. The plurality of movable elongated shielding members can be moved into an open or closed position on the card viewing device. The plurality of movable elongated shielding members are also formed from lightweight semi-rigid material. The hinge end of the movable elongated shielding members is movably formed on the hinge side of the card viewing device.

A transparent window member of the card viewing device is colored to match the color of the masking characters which over-lay the indicia on the challenge information side of the category game cards as previously described. Thus, when a category game card is inserted into the card receiving area of the card viewing device, the underlying challenge information becomes visible and is easily read when viewed through the transparent window member. In another embodiment where there are no masking characters over-laying the indicia, the transparent window member is not colored.

The plurality of score indicating means are of varying color and are spherical in shape. Each color of the score indicating means have been designed to correspond to a pre-determined category of the plurality of category game cards. In another embodiment, the score indicating means are designed to be constructed in varying shapes with each shape corresponding to a pre-determined category of the category game cards. Thus, the plurality of score indicating means holding devices are designed to accept a spherical shape and, in another embodiment, the plurality of score indicating means holding devices are designed to accept the various corresponding shapes of the score indicating means.

Before a game session begins, the card viewing device is arranged so that the shielding members are in a closed position. The category cards and the acronym cards are arranged on the table so that the challenge information side is down and the category indicia is up so that the category name can be read by the players. During play, at least one die is used to determine a player's challenge options. Depending on the number shown on the die after a player has rolled the die, the player may be required to guess a question in a category of his or her choice or answer a question in a category of his or her choice. For example, if the die roll results in one, the player losses his or her next turn and the at least one die is passed to a new player to the left. If the die roll is two or three, the player confronts a guess question challenge. If the die roll is four or five, the player confronts a guess answer challenge. Finally, if the die roll is six, the player may choose to confront a guess question challenge or a guess answer challenge.

Once the challenge is determined, the player then inserts the top card from the category selected into the card viewing device and play begins. The player has a pre-determined amount of time to complete the challenge for his or her play.

The card viewing device is designed so that a top portion of the category game card remains exposed and visible to the player when the game card is inserted into the card viewing device. This top portion of the category game card provides information as to the category or sub-category of the challenge as well as information concerning the total number of answers recited on the game card and a minimum number of correct answers required for guess answer challenge which will be discussed more fully hereinafter.

If the player's challenge is to guess the question, the player opens the appropriate movable elongated shielding member from a closed position shielding the corresponding first answer to an open position to expose the first answer. The player reads the first answer aloud and decides whether to guess the question.

If the player decides to guess the question, the guess is made aloud and the player then opens the appropriate movable elongated shielding member from a closed position shielding the corresponding question to an open position to expose the question. The player then determines whether the guess is correct. If the player determines the guess is incorrect, the player is out of play on the selected game card. The card viewing device with category game card is then passed to a new player to the left of the player.

The new player reads aloud the next answer and decides whether to guess the question. Play continues as above until all of the answers have been read aloud or all players have seen the question.

If a player determines that their guess is correct, the player reads the exposed question on the game card aloud. If the exposed question on the game card is different in any way from the guessed question cited by the player, the player to the right of the current player determines whether the cited guess is close enough to the exposed question on the game card to be judged correct. If the guessed question is judged to be close enough to the exposed question, or if the guessed question is identical to the exposed question, the player earns one score indicating means of the corresponding color or shape for the category challenged and a chance to guess an additional answer to the now known question. The player may pass or cite an additional answer to the known question.

If the player passes, the player remains in play on the selected game card. If the player cites an additional answer, the player opens all of the remaining movable elongated answer shielding members and looks at the remaining answers to determine if the additional guessed answer is correct. The player announces if the additional guessed answer is correct and, if correct, receives an additional score indicating means of the corresponding color or shape for the category challenged. The player is now out of play on the selected game card and the card viewing device with category game card is then passed to a new player to the left of the player. Similarly, if the additional guessed answer was correct, the player is now out of play on the selected game card and the card viewing device with category game card is then passed to a new player to the left of the player. Play continues with each new player in turn attempting to guess an additional answer to the now known question until all answers have been given or all players have seen all of the answers.

If a player has chosen to guess the question and the player determines that the guessed question is correct, but after reading the question on the game card aloud the player to the right determines that the guessed question is incorrect, the current player is out of play on the selected game card and loses their next turn. The card viewing device with category game card is then passed to a new player to the left of the player who attempts to guess an additional answer to the now known question. Play continues with each new player in turn attempting to guess an additional answer to the now known question until all answers have been given or all players have seen all of the answers.

If the initiating player decides not to guess the question, the player remains in play on the selected game card. Another player may guess the question by announcing "question" and that player guesses the question aloud and play proceeds in the manner described previously. After the turn of the player who has announced "question" is completed, play reverts to the player whose turn it would have been had there been no intervening play. If no other player announces "question", the card viewing device with game card is passed to a new player to the left who then reads the next answer aloud. The new player may now decide whether to guess the question and play proceeds as described above.

In another embodiment, if the player's challenge is to guess the question, the player may elect an Extra Challenge Alternative Play. In this variation, the player opens the first movable elongated answer shielding member to reveal the first answer on the playing card. The player recites as many answers as the total number of answers as indicated by the challenge information indicia, one of which must be the answer shown on the game card. Various game playing strategies and techniques become involved since the player can recite answers which may confuse other players and diminish their chance of success should the current player be unsuccessful in guessing the question.

If a player's challenge is to guess an answer, the player first reads the challenge information on the top portion of the game card. This information determines how many of the available answers on the particular game card the player must correctly identify out of the total number of possible answers. The player then opens the appropriate movable elongated shielding member to expose the question and the player reads the question aloud. The player then decides whether to guess only one answer or to guess a total number of possible answers, a minimum number of which must be correct as indicated on the top portion of the game card.

If the player decides to guess one answer, the guess is made aloud and the player opens the movable elongated shielding members covering all of the answers to determine whether the guess is correct. If the guess is correct, the player receives one score indicating means of the corresponding color or shape for the category challenged. The player is now out of play and a new player to the left guesses one additional answer. If the new player's guess is correct, the new player earns a score indicating means. The player is now out of play and a new player to the left guesses one additional answer. If the new player's guess is correct, the new player earns a score indicating means of the appropriate category. The player is now out of play and the card viewing device with game card is passed to a new player to the left. Play proceeds in a like manner until all answers have been given or all players have seen the answers.

If the initiating player's guess is incorrect, the player is removed from play on the challenge at hand and the card viewing device with game card is passed to a new player to the left. Similarly, if the new player's guess is incorrect, the new player is removed from play on the challenge at hand and the card viewing device with game card is passed to a new player to the left.

If, after reading the question aloud, the player decides to guess a total number of possible answers as indicated on the game card, the player will recite aloud a number of answers equal to the total number of answers as indicated on the game card. For example, the player may be required to correctly guess seven of twelve. Thus, the player must recite aloud twelve answers to the question, seven of which must be correct answers to the question. The player then looks at all of the answers to determine which guesses are correct, and announces which answers were correct. If the player correctly guesses the minimum number of answers, the player receives two score indicating means of the corresponding color or shape for the category challenged. The player then enters a bonus round where any other player reads challenge information on one of the plurality of acronym cards. If the current player correctly defines the acronym, the player may select an additional score indicating means of a color or shape of the player's choice. The current player is now out of play on the game card and the card viewing device with game card is passed to a new player to the left. The new player may attempt to guess an additional answer not yet given. In this situation, the new player may cam only one score indicating means as described when a player decides to guess only one answer.

If the original player did not have enough correct answers to meet the minimum required as indicated on the game card, that player is out of play on that challenge and the card viewing device with game card is passed to a new player to the left of the player.

The new player then attempts to guess one additional answer not yet given and play proceeds in the same manner as described. Play continues until all players have seen the answers or all correct answers have been given. When play is concluded on each challenge, the next player to begin a new round of play is the player to the left of the player that initiated play on the previously completed round of play.

Play proceeds in the above described manner until one player has attained two score indicating means for each category of category game cards. That player is then declared the winner.

The more important features of the present invention have been broadly outlined in order that the detailed description thereof that follows may be better understood and in order that the present contribution to the art may be better appreciated. There are additional features of the invention that will be more fully described hereinafter and which, together with the features outlined above, will form the subject matter of the claims appended hereto. Those skilled in the art will appreciate that the conception, upon which the present disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory review the nature and essence of the technical disclosure of the application. The abstract is neither intended to define the invention of the application, which is measured by the claims, nor is it intended to be limiting as to the scope of the invention in any way.

Accordingly, it is an object and advantage of the invention to provide a new and novel game that tests player's knowledge and reasoning skills by providing various types of challenges during the course of play.

Another object and advantage of the invention is to provide a new and novel game that provides varying levels of difficulty thereby allowing players of different playing skill to have a more equal opportunity of winning.

Another object and advantage of the invention is to provide a new and novel game wherein the number of and nature of the challenges provided are sufficient to minimize the incidence of repeat challenges a player faces either during the period of play of a single game session or over several game sessions.

Another object and advantage of the invention is to provide a new and novel game wherein the challenges provided are randomly selected thereby minimizing the number of repeat challenges a player faces either during the period of play of a single game session or over several game sessions.

Still another object and advantage of the invention is to provide a new and novel game wherein the challenges provided are easily and readily updated to coincide with player interest and changing trends.

Another object and advantage of the invention is to provide a new and novel game wherein the game play is designed to maintain a player's interest during the course of a single game session as well as over several game sessions.

Another object and advantage of the invention is to provide a new and novel game wherein players gain knowledge and develop better reasoning skills.

Another object and advantage of the invention is to provide a new and novel game which may be easily and efficiently manufactured and marketed.

Yet another object and advantage of the invention is to provide a new and novel game which is of durable and reliable construction.

These and other objects and advantages will become apparent from review of the drawings and from a study of the Description of the Preferred Embodiment relating to the drawings which has been provided by way of illustration only.

DESCRIPTION OF THE PREFERRED EMBODIMENT

Figure 1:
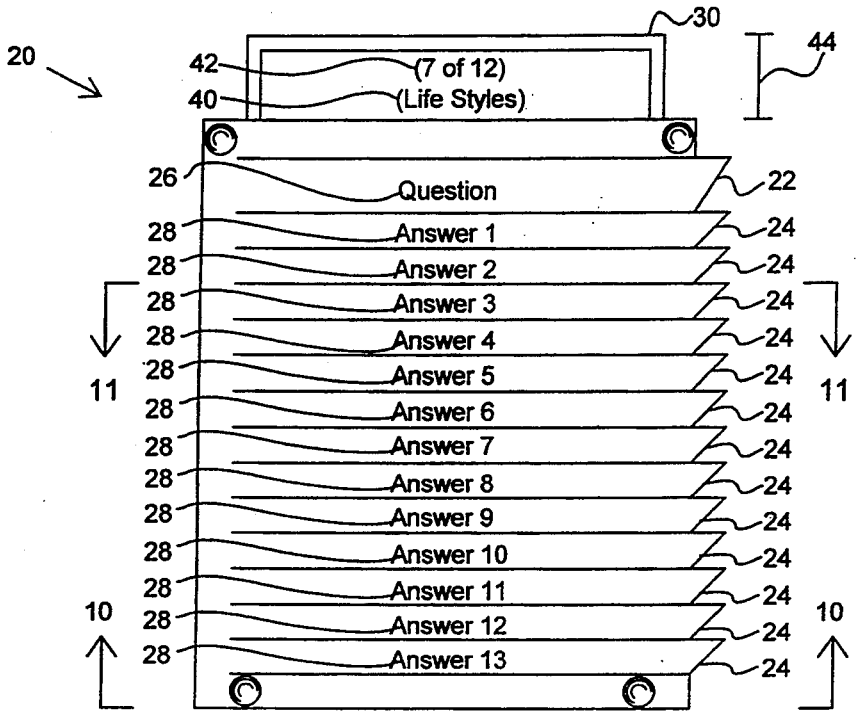
FIG. 1 is a top plan view of applicant's new and novel card viewing device employed by applicant's new and novel game, the new and novel card viewing device being shown in a closed position and with a category game card in place.

Referring to the drawings in general, applicant's new and novel game embodying the principles and concepts of the present invention will be described in detail.

Referring now to FIGS. 1 to 7, there is shown the components of a Preferred Embodiment of the applicant's new and novel game. More specifically, FIG. 1 of the drawings is a top plan view of a new and novel card viewing device shown generally by the numeral 20. The card viewing device 20 has been shown in FIG. 1 of the drawings with a plurality of movable elongated shielding members 22 and 24 in a closed position for purposes of clarity.

The card viewing device 20 has also been illustrated in FIG. 1 of the drawings with a category game card 30 in place for purposes of clarity. A top portion of category game card 30, shown generally by the numeral 44, is not blocked by card viewing device 20 and remains visible. Top portion 44 bears indicia 40 and indicia 42 which provide information as to a category or sub-category of a challenge as well as information concerning a total number of answers cited on a category game card 30 and a minimum number of correct answers required for guess answer challenge respectively which will be discussed more fully hereinafter.

In the Preferred Embodiment the applicant's card viewing device 20 is constructed from a semi-rigid material such as plastic, plastic polymers and the like. Other semi-rigid materials known in the art may also be used and are considered to be within the spirit and scope of the applicant's invention.

A plurality of movable elongated shielding members include a movable elongated question shielding member 22 and a plurality of movable elongated answer shielding members 24 movably formed on card viewing device 20. The plurality of movable elongated shielding members 22 and 24 bear indicia 26 and 28 respectively. Indicia 26 on the movable elongated question shielding member 22 indicates the respective movable elongated question shielding member 22 corresponds to a question on category card 30. Since card viewing device 20 has been shown in FIG. 1 of the drawings with the plurality of movable elongated shielding members 22 and 24 in a closed position, a question on category card 30 is not visible in FIG. 1 of the drawings. Similarly, indicia 28 on the plurality of movable elongated answer shielding members 24 indicates the respective plurality of movable elongated answer shielding members 24 corresponds to an answer on category card 30. Since card viewing device 20 has been shown in FIG. 1 of the drawings with the plurality of movable elongated shielding members 22 and 24 in a closed position, answers on category card 30 are not visible in FIG. 1 of the drawings.

In the Preferred Embodiment, the plurality of movable elongated shielding members 22 and 24 are also constructed from a semi-rigid material such as plastic, plastic polymers and the like. Other semi-rigid materials known in the art may also be used and are considered to be within the spirit and scope of the applicant's invention. The card viewing device 20 and the plurality of movable elongated shielding members 22 and 24 will be discussed more fully hereinafter.

Figure 2:
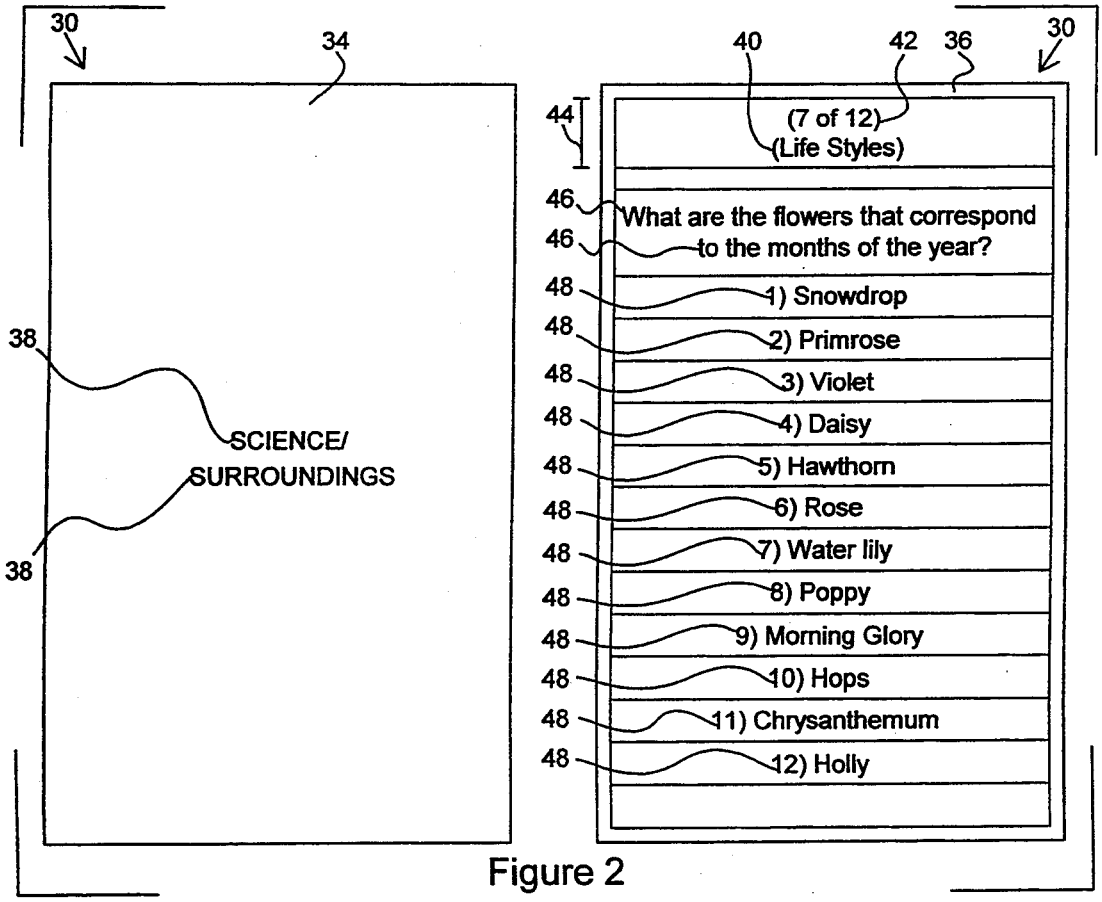
FIG. 2 is a plan view of a category game card employed by applicant's new and novel game.
Figure 3:
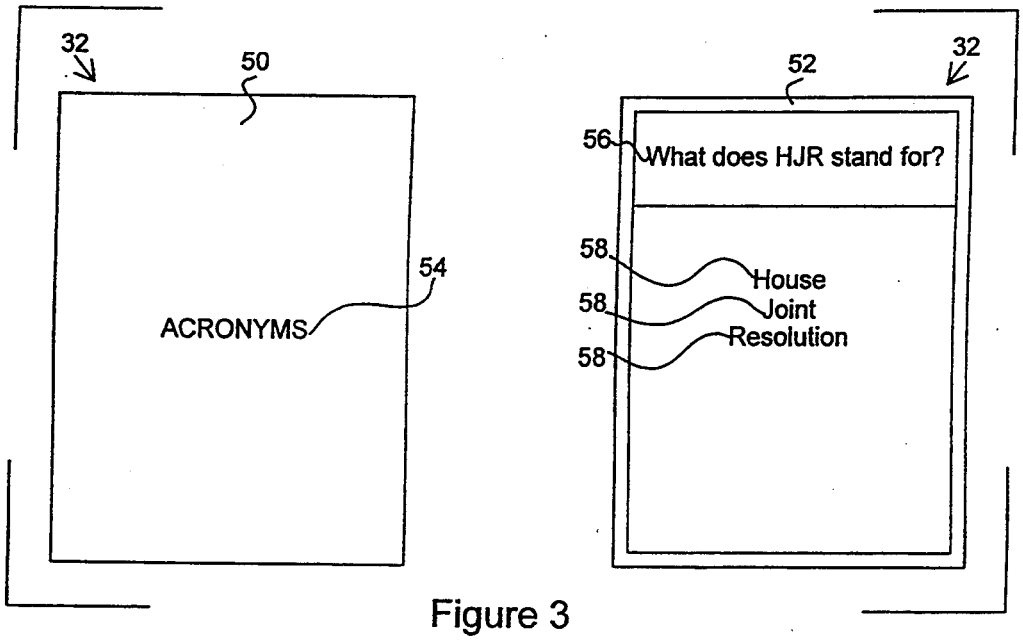
FIG. 3 is a plan view of an acronym game card employed by applicant's new and novel game.
Figure 4:
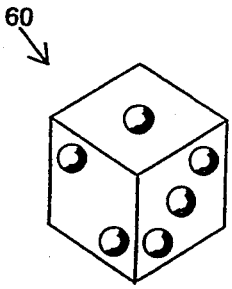
FIG. 4 is a perspective view of at least one die employed by applicant's new and novel game.

Referring now to FIGS. 2 and 3 of the drawings there is illustrated game cards shown generally by the numerals 30 and 32 respectively. FIGS. 2 and 3 of the drawings are plan views of game cards 30 and 32 respectively. In FIG. 2 of the drawings a category game card 30 is shown and in FIG. 3 of the drawings an acronym game card 32 is shown. Applicant's new and novel invention employs a plurality of category cards and acronym cards. The single category card 30 and single acronym card 32 as shown in FIGS. 2 and 3 of the drawings are for illustrative purposes only and are not to be considered limiting with respect to the number of or nature of category cards and acronym cards provided in the present invention. Other category cards and acronym cards may also be provided and are considered to be within the spirit and scope of the applicant's invention.

Referring now to FIG. 2 of the drawings, a category card, shown generally by the numeral 30, has a category name side 34 and an opposing challenge information side 36. Indicia 38 on the category name side 34 describes the category to which a particular category card 30 belongs. The indicia 38 on category card 30 as shown in FIG. 2 of the drawings is for illustrative purposes only and is not to be considered limiting with respect to the number of or nature of categories provided in the present invention. Other categories may also be provided and are considered to be within the spirit and scope of the applicant's invention.

Still referring to FIG. 2 of the drawings, there is shown an opposing challenge information side 36 of a category card 30. Indicia 40 on the opposing challenge information side 36 of category card 30 describes a sub-category to which a particular category card 30 belongs. The indicia 40 on the category card 30 as shown in FIG. 2 of the drawings is for illustrative purposes only and is not to be considered limiting with respect to the number of or nature of sub-categories provided in the present invention. Other sub-categories may also be provided and are considered to be within the spirit and scope of the applicant's invention.

Opposing challenge information side 36 of category card 30 also bears indicia 42 which describes a total number of answers possible and a minimum number of correct answers required for specific portions of game play as will be discussed more fully hereinafter. The indicia 42 on the category card 30 as shown in FIG. 2 of the drawings is for illustrative purposes only and is not to be considered limiting with respect to the number of or nature of answers provided or required in the present invention. Other total and minimum required numbers may also be provided and are considered to be within the spirit and scope of the applicant's invention. Indicia 40 and indicia 42 are located within a top portion 44 of category game card 30.

The opposing challenge information side 36 also bears indicia 46 which describes a challenge question for a particular category card 30. Additionally, the opposing challenge information side 36 of category card 30 bears a plurality of indicia 48 which describes various answers to the question described by indicia 46. Indicia 46 and 48 as shown on category game card 30 in FIG. 2 of the drawings is for illustrative purposes only and is not to be considered limiting with respect to the number of or nature of questions and answers provided in the present invention. Other questions and answers may also be provided and are considered to be within the spirit and scope of the applicant's invention.

In the Preferred Embodiment, indicia 46 and 48 are of a color other than black or white. Masking characters, such as X's, blocks of sufficient size and shape to cover the indicia 46 and 48, and the like, are over-laid on the indicia 46 and 48. The color of the masking characters is the corresponding complementary color to the color of the indicia 46 and 48. Thus if the indicia 46 and 48 is blue, the masking characters would be red, the complementary color to blue. When this combination is viewed with the naked eye, the indicia 46 and 48 are effectively masked out and not visible or easily read. However, when category game card 30 is placed in card viewing device 20, which is not shown in FIG. 2, a transparent viewing window in card viewing device 20, also not shown in FIG. 2, whose color matches that of the masking characters, effectively cancels or nullifies the effects of the masking characters thereby revealing the indicia 46 and 48. If the masking characters are red as in the above example, a transparent viewing window in card viewing device 20 would also be colored red. Card viewing device 20 and an associated transparent window member will be discussed more fully hereinafter.

The color of the indicia 46 and 48 has not been shown in FIG. 2 of the drawings for purposes of clarity. Similarly, the masking characters have not been shown in FIG. 2 of the drawings for purposes of clarity. Various combinations of corresponding complementary colors may be used and are considered to be within the spirit and scope of the invention.

In another embodiment, the indicia 46 and 48 may be of any color readily visible to the naked eye with no masking characters over-laying the indicia 46 and 48. In this embodiment, a transparent window member is not colored thereby allowing the indicia 46 and 48 to be easily viewed and read. However, greater care must be exercised by a player to prevent himself or any other player from viewing the indicia 46 and 48 before a category game card 30 is placed into card viewing device 20.

Also in another embodiment, challenge information may be located on both sides of a category game card 30 thereby reducing the total number of category game cards 30 without reducing the number of challenges.

Referring now to FIG. 3 of the drawings there is shown an acronym game card, shown generally by the numeral 32, having a title side 50 and an opposing challenge information side 52. Indicia 54 on the title side 50 indicates the game card is an acronym game card 32. The indicia 54 on the acronym game card 32 as shown in FIG. 3 of the drawings is for illustrative purposes only and is not to be considered limiting with respect to the number of or nature of titles provided in the present invention. Other titles may also be provided and are considered to be within the spirit and scope of the applicant's invention.

Acronym game card 32 also has an opposing challenge information side 52 which bears indicia 56 and 58. Indicia 56 describes a challenge acronym for a particular acronym game card 32. The indicia 58 describes an answer to the challenge acronym. The indicia 56 and 58 on the acronym game card 32 as shown in FIG. 3 of the drawings is for illustrative purposes only and is not to be considered limiting with respect to the number of or nature of acronyms and answers provided in the present invention. Other acronyms and answers may also be provided and are considered to be within the spirit and scope of the applicant's invention.

In another embodiment, challenge information may be located on both sides of the acronym game cards thereby reducing the total number of acronym game cards without reducing the number of challenges. In this embodiment, players would draw an acronym game card from the bottom of a pile of acronym game cards thus preventing any player from seeing the challenge information prior to play on the selected acronym game card.

In the Preferred Embodiment, the before described indicia 26, 28, 38, 40, 42, 46, 48, 54, 56 and 58 is in the form of text. Other forms of indicia may also be used and are considered to be within the spirit and scope of the invention.

Referring now to FIGS. 4 to 7 there is shown the remaining components of a Preferred Embodiment of the applicant's new and novel game. More specifically, FIG. 4 of the drawings is a perspective view of at least one die shown generally by the numeral 60. In the Preferred Embodiment, the at least one die 60 is six sided, each side having indicia formed thereon corresponding to a number, each number being different from any other number on any other side of the least one die. The at least one die is used to determine which player begins a play session and is subsequently used to determine the nature of a challenge for each round of play. The nature of a challenge for a given player's turn will be discussed more fully hereinafter. In the Preferred Embodiment, at least one die is used for the above described purposes, however, more than one die may also be used and is considered to be within the spirit and scope of the invention.

Figure 5:
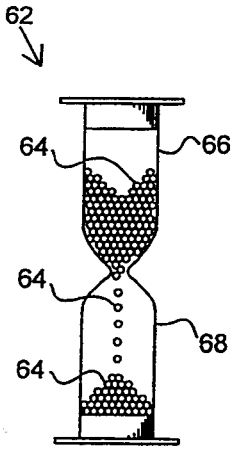
FIG. 5 is a front elevational view of a timing device employed by applicant's new and novel game.

Referring now to FIG. 5 of the drawings there is shown a timing device, shown generally by the numeral 62. FIG. 5 of the drawings is a front elevational view of a timing device 62. Timing device 62 is used to define a pre-determined length of time a player is allotted to meet a particular challenge during a round of play. In the Preferred Embodiment, the timing device is of the type having a fine granular material such as sand 64 or the like, enclosed in a double-chambered container so that a pre-determined amount of sand 64 will take one minute to fall from an upper chamber 66 to a lower chamber 68 of the timing device 62. Other timing devices and lengths of time allotted to each player may also be used and are considered to be within the spirit and scope of the invention.

Figure 6:
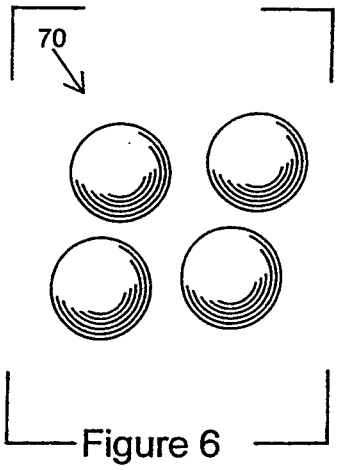
FIG. 6 is a perspective view of a plurality of score indicating means employed by applicant's new and novel game.

Referring now to FIG. 6 of the drawings there is shown a plurality of score indicating means shown generally by the numeral 70. FIG. 6 of the drawings is a perspective view of a plurality of score indicating means 70. In the Preferred Embodiment, the plurality of score indicating means 70 are spherical in shape and are colored so that a pre-determined number of score indicating means 70 are of one color, a pre-determined number of score indicating means 70 are of another color and so on until there are as many colored groups of score indicating means 70 as there are categories of category game cards 30. For example, in the Preferred Embodiment, there are five categories of category game cards 30 which are designated as History/Literature, Leisure, Show Business, Science/Surroundings and Words. Thus, there are five corresponding colors of score indicating means 70. Yellow score indicating means correspond to History/Literature, green score indicating means correspond to Leisure, red score indicating means correspond to Show Business, blue score indicating means correspond to Science/Surroundings and black score indicating means correspond to Words. In the Preferred Embodiment, the plurality of score indicating means 70 are marbles, balls, bearings and the like. Other shapes and colors may also be used and are considered to be within the spirit and scope of the invention.

In another embodiment, the plurality of score indicating means 70 are formed having different shapes so that each shape corresponds to a specific category of category game cards 30. For example, a spherical shaped score indicating means may correspond with the category History/Literature, a square shape may correspond with Leisure, a crystal star shape may correspond with Show Business, a pyramid shape may correspond with Science/Surroundings and an octagonal shaped score indicating means may correspond to Words.

Figure 7:
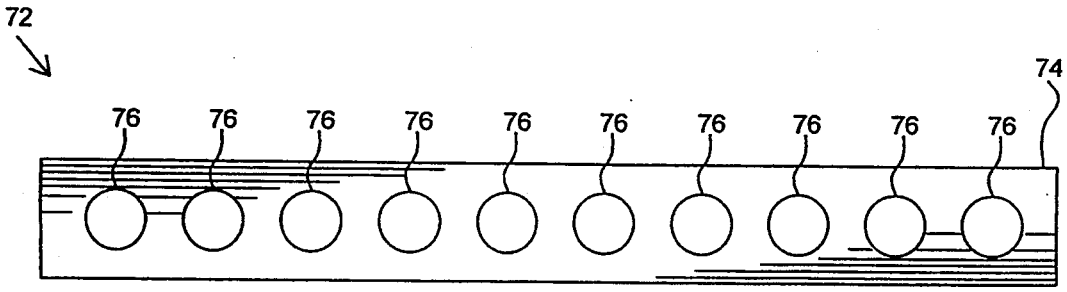
FIG. 7 is an top plan view of a score indicating means holding device employed by applicant's new and novel game.

Referring now to FIG. 7 of the drawings there is shown a score indicating means holding device, shown generally by the numeral 72. FIG. 7 of the drawings is a top plan view of a score indicating means holding device 72. The score indicating means holding device 72 has a base 74 and a plurality of score indicating means receiving receptacles 76. In the Preferred Embodiment, a plurality of score indicating means holding devices 72 are provided and are constructed of lightweight rigid material such as wood, plastic, aluminum and the like. Other rigid materials known in the art may also be used and are considered to be within the spirit and scope of the invention.

Additionally, in the Preferred Embodiment, score indicating means holding device 72 is a marble tray constructed in a rectangular shape and having a plurality of score indicating means receiving receptacles 76 arranged in a single line along a length of the base 74 of score indicating means holding device 72. The configuration of score indicating means holding device 72 is shown in FIG. 7 of the drawings for purposes of illustration only. Other configurations may also be used and are considered to be within the spirit and scope of the invention. Similarly, the plurality of score indicating means receiving receptacles 76 as shown in FIG. 7 of the drawings have been designed to receive a plurality of score indicating means 70 of the shape as shown in FIG. 6 of the drawings and have been so illustrated in FIG. 7 of the drawings for purposes of clarity only. Other configurations may also be used and are considered to be within the spirit and scope of the invention.

Figure 8:
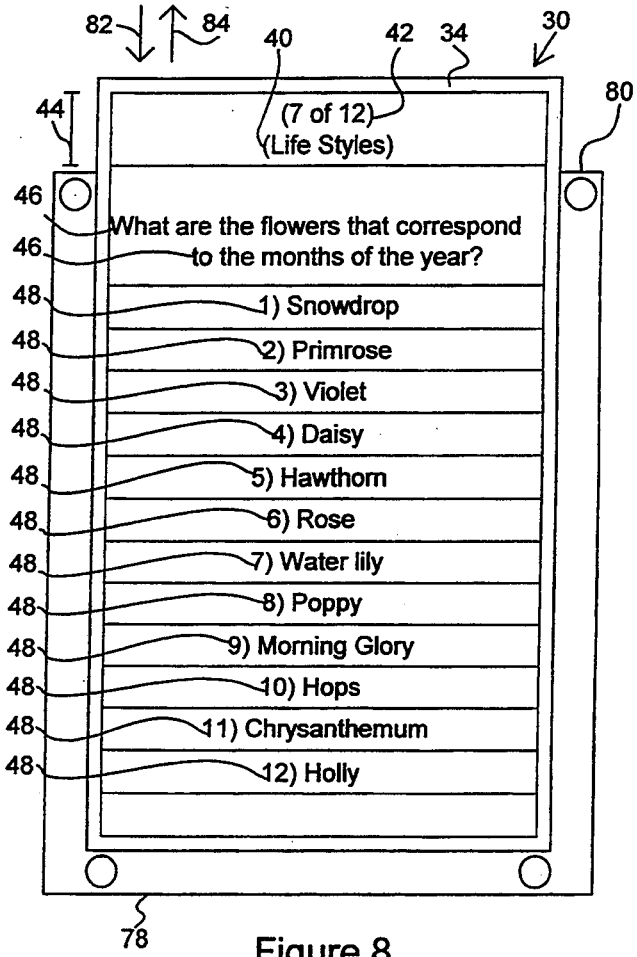
FIG. 8 is a top plan view of applicant's new and novel card viewing device shown with a plurality of movable elongated shielding members and a transparent window member removed.

Referring now to FIGS. 8 to 13 of the drawings there will be described in detail applicant's new and novel game card viewing device shown generally by the numeral 20. FIG. 8 is a top plan view of applicant's new and novel card viewing device, shown generally by the numeral 20, and is similar to FIG. 1 of the drawings. However, in FIG. 8, the plurality of movable elongated shielding members 22 and 24 are not shown for purposes of clarity.

Card viewing device 20 is constructed having an end 78 and an opposite end 80. End 78 is closed so that a category game card 30 is retained and properly oriented within card viewing device 20. Opposite end 80 is open so that a category game card 30 can be inserted into the card viewing device 20 as shown by the directional arrow 82 and removed from the card viewing device 20 as shown by the directional arrow 84. A transparent window member, not shown in FIG. 8 for purposes of clarity, allows a player to read indicia 46 and 48 on a category game card 30. The transparent window member will be discussed more fully hereinafter.

The indicia 46 and 48 as shown on the category card 30 in FIG. 8 of the drawings is for illustrative purposes only and is not to be considered limiting with respect to the number of or nature of questions and answers provided in the present invention. Other questions and answers may also be provided and are considered to be within the spirit and scope of the applicant's invention.

Figure 9:
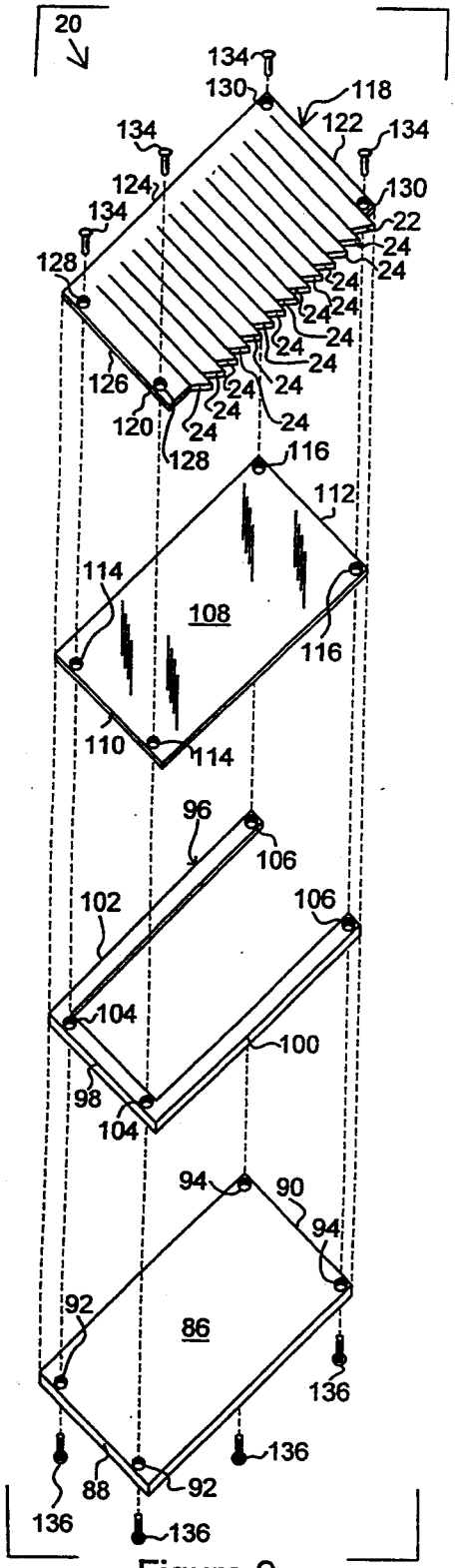
FIG. 9 is an exploded view of applicant's new and novel card viewing device.

Referring now to FIG. 9 of the drawings there is shown an exploded view of a card viewing device shown generally by the numeral 20. The card viewing device 20 is constructed in a layered fashion and formed from semi-rigid material such as plastic and the like. A base member, shown generally by the numeral 86, having an end 88, an opposite end 90 and a plurality of holes 92 and 94 forms a first or base layer. A U-shaped separating member, shown generally by the numeral 96, having an end 98, first leg 100, second leg 102 and a plurality of holes 104 and 106 is fixedly attached to base member 86 so that holes 104 and 106 of U-shaped separating member 96 align with holes 92 and 94 respectively of base member 86 thus forming a second layer.

A transparent window member, shown generally by the numeral 108, having an end 110, an opposite end 112 and a plurality of holes 114 and 116 is fixedly attached to U-shaped separating member 96 so that holes 114 and 116 of transparent window member 108 align with the holes 104 and 106 respectively of U-shaped separating member 96 thus forming a third layer. The resulting layered construction of base member 86, U-shaped separating member 96 and transparent window member 108 creates an opening into which a category game card 30 can be inserted in the end 80 of the card viewing device 20 in the direction of the arrow 82 as shown in FIG. 8 of the drawings. Referring again to FIG. 9 of the drawings, end 98 of U-shaped separating member 96 retains a category game card 30 in the card viewing device 20.

Still referring to FIG. 9 of the drawings and in the Preferred Embodiment, the transparent window member 108 is formed from colored transparent semi-rigid material such as plastic and the like. The color of transparent window member 108 in the Preferred Embodiment is designed to be red. Thus, referring briefly back to FIG. 2 of the drawings, when the indicia 46 and 48 of a category game card 30 is colored blue and said indicia is then over-laid with a plurality of red masking characters as previously described, the indicia 46 and 48 is only visible and easily read when viewed through the red transparent window member of the card viewing device 20 and is not easily visible or read with the naked eye. This prevents any player from reading challenge information represented by the indicia 46 and 48 while a player is inserting a category game card 30, not shown in FIG. 9 of the drawings for purposes of clarity, into the card viewing device 20. The red transparent window member 108 cancels the effect of the red masking characters and the underlying blue indicia becomes visible and easy to read. Other color combinations utilizing corresponding complementary colors may be used and are considered to be within the spirit and scope of the invention.

In another embodiment, the transparent window member 108 is formed from transparent non-colored semi-rigid material such as plastic and the like. In this embodiment the indicia 46 and 48 on a category game card 30 may be of any color readily visible to the naked eye. This arrangement does not provide the extra security as defined and described above and other measures must be taken by the players to ensure fair play. Other transparent semi-rigid materials known in the art may also be used and are considered to be within the spirit and scope of the invention.

Still referring to FIG. 9 of the drawings there is shown a top member, shown generally by the numeral 118, having an end 120, an opposite end 122, a hinge side 124, a bottom surface 126 and a plurality of holes 128 and 130 is fixedly attached to transparent window member 108 so that holes 128 and 130 of shielding member 118 align with holes 114 and 116 respectively of transparent window member 108 thus forming a final layer.

The top member 118 has continuously formed thereon a plurality of movable elongated shielding members 22 and 24. Top member 118 also has flexing means 132 in the form of a V-shaped groove or notch formed in bottom surface 126 at the juncture of the plurality of movable elongated shielding members 22 and 24 and hinge side 124 of top member 118. The flexing means 132, which cannot be seen in FIG. 9 but which is clearly shown in FIG. 11 of the drawings, is designed to provide a spring action to the plurality of movable elongated shielding members 22 and 24, allowing the plurality of movable elongated shielding members 22 and 24 to be easily opened and closed. Flexing means 132 will be discussed more fully hereinafter.

The plurality of holes in each of the before described members making up the layered configuration of card viewing device 20 are arranged to ensure proper orientation of the individual members, base member 86, U-shaped separating member 96, transparent window member 108 and top member 118, relative to one another. Holes 92 in base member 86 are located adjacent to end 88 and set away from any corners at end 88. The plurality of holes 104 of U-shaped separating member 96, holes 114 of transparent window member 108 and holes 128 of top member 118 are similarly arranged on each respective member. Holes 94 of base member 86 are located adjacent to opposite end 90 of base member 86 and are also set in close proximity to any corners at opposite end 90. The plurality of holes 106 of U-shaped separating member 96, holes 116 of transparent window member 108 and holes 130 of top member 118 are similarly arranged on each respective member. The resulting arrangement of the plurality of holes allows each of the before described members to be properly aligned and oriented with respect to each successive member in the layered configuration. The layered arrangement also properly orients the flexing means 132 to provide a spring action which will be discussed more fully hereafter.

In the Preferred Embodiment, the before described members are fixedly attached in the previously described layered fashion using a plurality of tee-nuts 134 and a plurality of screws 136. The plurality of tee-nuts 134 are inserted into the plurality of holes on the various before described members so that a flange of the plurality of tee-nuts 134 rests on shielding member 118. The plurality of screws 136 are then used to fasten the layers together, a head of the plurality of screws 136 resting on base member 86. In the Preferred Embodiment, the plurality of tee-nuts 134 and the plurality of screws 136 are formed from nylon. Other fastening means such as rivets, staples, plastic adhesives and the like and other fastening means known in the art may also be used and are considered to be within the spirit and scope of the invention.

Figure 10:
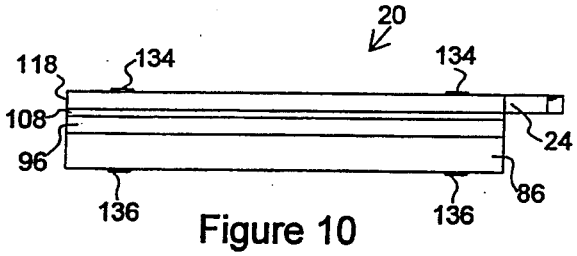
FIG. 10 is an elevational end view of applicant's new and novel card viewing device taken along lines 10—10 of FIG. 1.

Referring now to FIG. 10 of the drawings there is shown an elevational end view of the applicant's new and novel card viewing device, shown generally by the numeral 20. FIG. 10 of the drawings is taken along lines 10—10 of FIG. 1 of the drawings and illustrates the before described layering of the card viewing device 20. U-shaped separating member 96 is fixedly attached to base member 86, transparent window member 108 is fixedly attached to U-shaped separating member 96 and top member 118 is fixedly attached to transparent window member 108 as previously described. Base member 86, U-shaped separating member 96, transparent window member 108 and top member 118 are fixedly attached using fastening means 134 and 136 as previously described.

Figure 11:
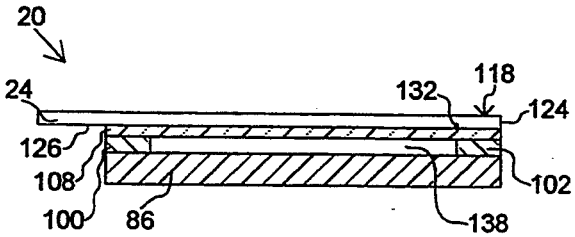
FIG. 11 is cross-sectional view of applicant's new and novel card viewing device taken along lines 11—11 of FIG. 1.

Referring now to FIG. 11 of the drawings there is shown a cross-sectional view of applicant's new and novel card viewing device, shown generally by the numeral 20 and taken along lines 11—11 of FIG. 1 of the drawings. FIG. 11 illustrates how the layered configuration of the card viewing device 20 produces open area 138 allowing a category card 30, which is not shown for purposes of clarity, to be inserted into the card viewing device 20. FIG. 11 also illustrates flexing means 132 sown in FIG. 11 in the form of a V-shaped groove, formed in bottom surface 126 of a top member, shown generally the numeral 118.

First leg 100 and second leg 102 of U-shaped separating member 96 are fixedly attached to base member 86 and oriented to produce open area 138. Transparent window member 108 is fixedly attached to legs 100 and 102 of U-shaped separating member 96. Thus, the layered configuration of the card viewing device 20 products open area 138 allowing a category card 30, not shown for purposes of clarity, to be inserted into or removed from the card viewing device 20.

In the Preferred Embodiment, flexing means 132 is a V-shaped groove continuously formed in the bottom surface 126 near hinge side 124 of top member 118. Other flexing configurations know in the art may also be used and are considered to be within the spirit and scope of the invention. Flexing means 132 allows a plurality of movable elongated shielding members 22, not seen in FIG. 11, and 24 to be easily moved thereby allowing repeated opening and closing of the plurality of movable elongated shielding members 22 and 24 to expose the underlying transparent window member 108 and thus, the underlying indicia 46 and 48 on a category game card 30, not shown in FIG. 11 for purposes of clarity. Additionally, the flexing means 132 increase the durability and longevity of the card viewing device 20 by providing a natural flexing point on the plurality of movable elongated shielding members 22 and 24 of the top member 118.

Figure 12:
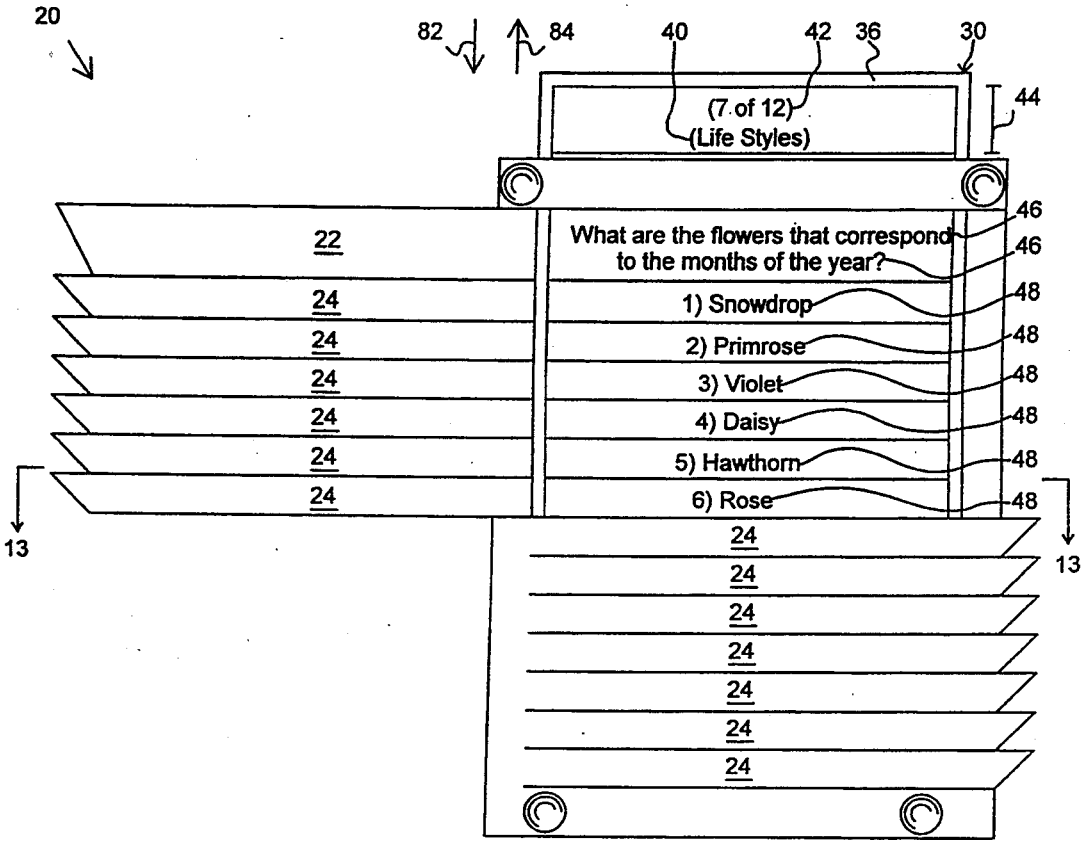
FIG. 12 is a top plan view of applicant's new and novel card viewing device showing the movable elongated question shielding member and some of the movable elongated answer shielding members in an open position.

Referring now to FIG. 12 of the drawings, there is shown a top plan view of applicant's new and novel card viewing device, shown generally by the numeral 20, with a movable elongated question shielding member 22 and some of the plurality of movable elongated answer shielding members 24 in an open position and some of the plurality of movable elongated answer shielding members 24 in a closed position. A category game card 30 is shown in place in the card viewing device 20 for purposes of clarity. With a movable elongated question shielding member 22 and some of the movable elongated answer shielding members 24 in the open position, indicia 46 and 48 on a challenge information side 36 of a category game card 30 is readily visible to a player. Any remaining indicia 44 and 48 is shielded by a plurality of movable elongated answer shielding members 24 in the closed position. A category game card 30 is inserted into the card viewing device 20 in the direction of arrow 82 and removed from the card viewing device 20 in the direction of arrow 84 as shown in FIG. 12.

Figure 13:
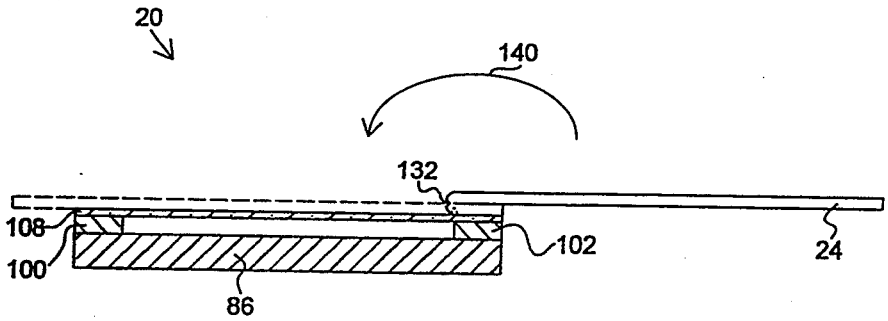
FIG. 13 is a cross sectional end view of applicant's new and novel card viewing device taken along lines 13—13 of FIG. 12.

Referring now to FIG. 13 of the drawings, there is shown applicant's new and novel card viewing device shown generally by the numeral 20 with a movable elongated answer shielding member 24, in an open position. FIG. 13 is a cross sectional view taken along lines 13—13 of FIG. 12.

When a movable elongated answer shielding member 24 is held in an open position as shown by solid lines in FIG. 13, movable elongated answer shielding member 24 is compressed at an area directly above and adjacent to flexing means 132. This results in a natural tension on the movable elongated answer shielding member 24 thereby urging movable elongated answer shielding member 24 to return to a closed position as illustrated in FIG. 13 by dashed lines. When the movable elongated answer shielding member 24 is released, the tension created by the compression of movable elongated answer shielding member 24 at the area directly above and adjacent to flexing means 132 is relieved and the movable elongated answer shielding member 24 returns to a closed position, as indicated by dashed lines in FIG. 13 of the drawings, in the direction of the arrow 140.

Figure 14:
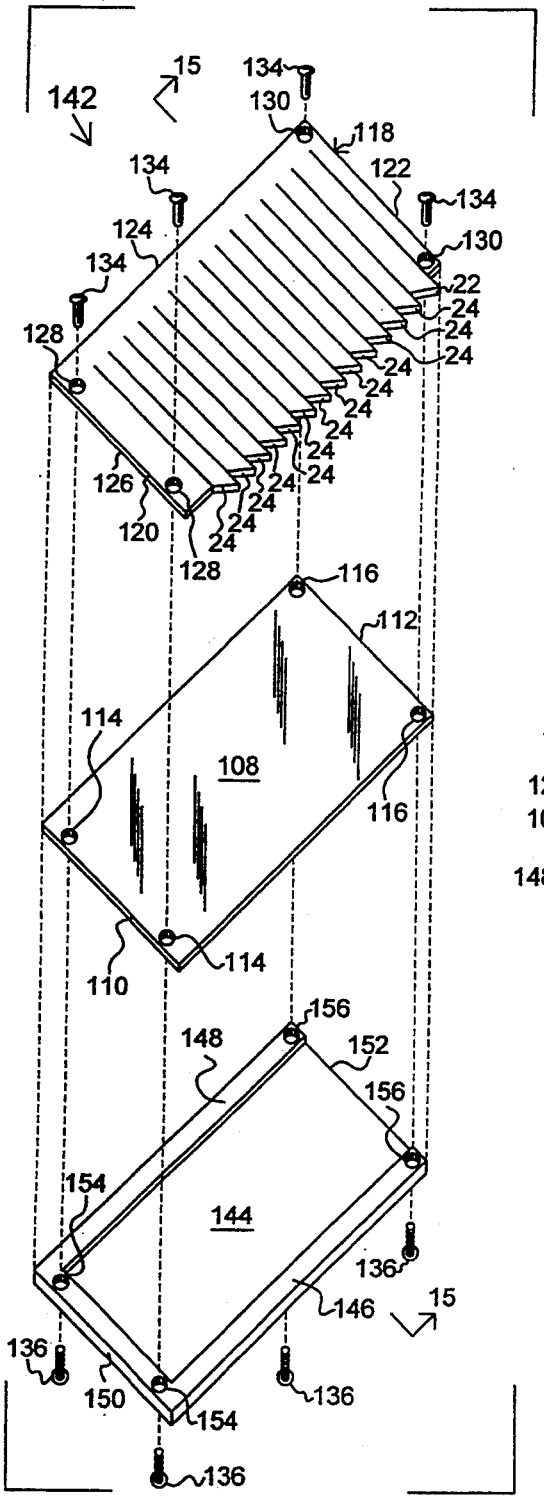
FIG. 14 is an exploded view of a modification of applicant's new and novel card viewing device.
Figure 15:
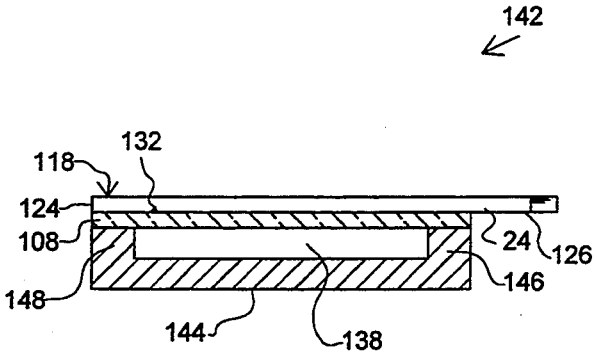
FIG. 15 is cross-sectional view of a modification of applicant's new and novel card viewing device taken along lines 15—15 of FIG. 14.

Referring now to FIGS. 14 and 15 of the drawings in general, there will be described in detail a modification of applicant's new and novel game card viewing device shown generally by the numeral 142. Referring now to FIG. 14 of the drawings there is shown an exploded view of a modified card viewing device shown generally by the numeral 142. Modified card viewing device 142 is constructed in a layered fashion and formed from a semi-rigid material such as plastic, plastic polymers and the like. Other semi-rigid materials known in the art may also be used and are considered to be within the spirit and scope of the applicant's invention.

A modified base member, shown generally by the numeral 144, having continuously formed raised support legs 146 and 148, raised support end 150, opposite end 152 and a plurality of holes 154 and 156 forms a first or base layer and is formed by injection molding techniques known in the art.

A transparent window member, shown generally by the numeral 108, having an end 110, an opposite end 112 and a plurality of holes 114 and 116 is fixedly attached to modified base member 144 so that holes 114 and 116 of transparent window member 108 align with holes 154 and 156 respectively of modified base member 144 thus forming a second layer. The layered construction of the modified base member 144 and transparent window member 108 creates an open area into which a category game card 30 can be inserted into the modified card viewing device 142. Raised support end 150 of modified base member 144 retains a category game card 30, not shown in FIG. 14 for purposes of clarity, in the modified card viewing device 142.

Still referring to FIG. 14 of the drawings there is shown a top member, shown generally by the numeral 118, having an end 120, an opposite end 122, a hinge side 124, a bottom surface 126 and a plurality of holes 128 and 130. Top member 118 is fixedly attached to transparent window member 108 so that holes 128 and 130 of top member 118 align with holes 114 and 116 respectively of transparent window member 108 thus forming a final layer.

Top member 118 has continuously formed thereon a plurality of movable elongated shielding members 22 and 24. Top member 118 also has flexing means 132 in the form of a V-shaped groove or notch formed in bottom surface 126 at the juncture of plurality movable elongated shielding members 22 and 24 and hinge side 124 of top member 118. The flexing means 132, which cannot be seen in FIG. 14, is designed to provide a spring action to the plurality of movable elongated shielding members 22 and 24, allowing the plurality of movable elongated shielding members 22 and 24 to be easily opened and closed as previously described.

The plurality of holes in each of the before described members making up the layered configuration of modified card viewing device 142 are arranged to ensure proper orientation of the individual members, modified base member 144, transparent window member 108 and top member 118, relative to one another. Holes 154 in modified base member 144 are located in raised support end 150 and are set away from any corners at raised support end 150. Raised support legs 146 and 148 have holes 156 located adjacent to opposite end 152 of modified base member 144 and are set in close proximity to any corners at opposite end 152. The plurality of holes 114 in transparent window member 108 are located adjacent to the 110 and set away from any corners at end 110. The plurality of holes 128 of top member 118 are similarly arranged. The plurality of holes 116 in transparent window member 108 are located adjacent to opposite end 112 and are set in close proximity to any corners at opposite end 112. The plurality of holes 130 in top member 118 are similarly arranged. The resulting arrangement of the plurality of holes allows each of the before described members to be properly aligned and oriented with respect to each successive member in the layered configuration. The layered arrangement also properly orients the flexing means 132 to provide a spring action as previously described.

In the Preferred Embodiment, the before described members are fixedly attached in the previously described layered fashion using a plurality of tee-nuts 134 and a plurality of screws 136. The plurality of tee-nuts 134 are inserted into the plurality of holes on the various before described members so that a flange of the plurality of tee-nuts 134 rests on top member 118. The plurality of screws 136 are then used to fasten the layers together, a head of the plurality of screws 136 resting on modified base member 144. In the Preferred Embodiment, the plurality of tee-nuts 134 and the plurality of screws 136 are formed from nylon. Other fastening means such as rivets, staples, plastic adhesives and the like and other fastening means known in the art may also be used and are considered to be within the spirit and scope of the invention.

Referring now to FIG. 15 of the drawings there is shown a cross-sectional view of modified card viewing device, shown generally by the numeral 142 and taken along lines 15—15 of FIG. 14 of the drawings. FIG. 15 illustrates how the layered configuration of modified card viewing device 142 produces open area 138 allowing a category card 30, which is not shown for purposes of clarity, to be inserted into modified card viewing device 142.

Transparent window member 108 is fixedly attached to raised support legs 146 and 148 of modified base member 144 thereby producing open area 138 and allowing a category card 30, not shown for purposes of clarity, to be inserted into or removed from the modified card viewing device 142.

A top member, shown generally by the numeral 118, is fixedly attached to transparent window member 108 as previously described. Modified base member 144, transparent window member 108 and top member 118 are fixedly attached using fastening means 134 and 136 as previously described. Flexing means 132 is a V-shaped groove continuously formed in bottom surface 126 near hinge side 124 of top member 118 as previously described. Other flexing configurations know in the art may also be used and are considered to be within the spirit and scope of the invention.

Referring now to FIG. 16 of the drawings, there will be described in detail applicant's new and novel method of playing applicant's new and novel game. FIG. 16 is a block diagram showing the applicant's new and novel method. Applicant's new and novel game is designed for at least two players or at least two teams of players. More players or teams of players may be involved in a play session. A play session runs from the commencement of game play until a winning player or winning team of players is declared. The method of play, that is the rules of the game, are identical for individual players and teams of players. Thus, the following description is directed toward a game session having individual players for purposes of clarity.

In the Preferred Embodiment, prior to commencement of a game session, a plurality of game cards including category cards and acronym cards having a category name side bearing indicia indicating a category and a challenge information side bearing indicia describing challenge information, the indicia being in the form of text, at least one card viewing device having a plurality of movable elongated shielding members, at least one die, a plurality of score indicating means of varying color, the score indicating means being marbles, a plurality of score indicating means holding devices, the score indicating means holding devices being marble trays, and at least one timer are provided. A scratch pad and pencil may also be provided.

Also in the Preferred Embodiment, there are five categories designated as History/Literature, Leisure, Show Business, Science/Surroundings and Words. Each category corresponds to a color of the plurality of score indicating means or marbles. Yellow marbles correspond to History/Literature, green marbles correspond to Leisure, red marbles correspond to Show Business, blue marbles correspond to Science/Surroundings and black marbles correspond to Words.

The plurality of game cards are arranged on a surface, such as a table, with the category name side up and readily visible by all players and the challenge information side down and not visible to any player. The card viewing device has a viewing side having a plurality of movable elongated shielding members thereon, the plurality of movable elongated shielding members bearing indicia indicating a movable elongated question shielding member and a plurality of movable elongated answer shielding members. The plurality of movable elongated shielding members are placed in a closed position before game play begins.

Each player selects a score indicating means holding device or marble tray. A game session commences with all of the players rolling the at least one die to determine who will initiate a first round of game play. In the Preferred Embodiment, the player rolling the highest number on the at least one die initiates the first round of game play. Players may agree to use other number priorities to determine which player will initiate the first round of game play. For example, the players may agree that the player rolling the lowest number shall initiate the first round of game play. Alternatively, the players may agree to use two or more die in determining the player who will initiate the first round of game play. During each round of play, a player will have a pre-determined length of time, as determined by a timer, to complete a challenge.

Figure 16A:
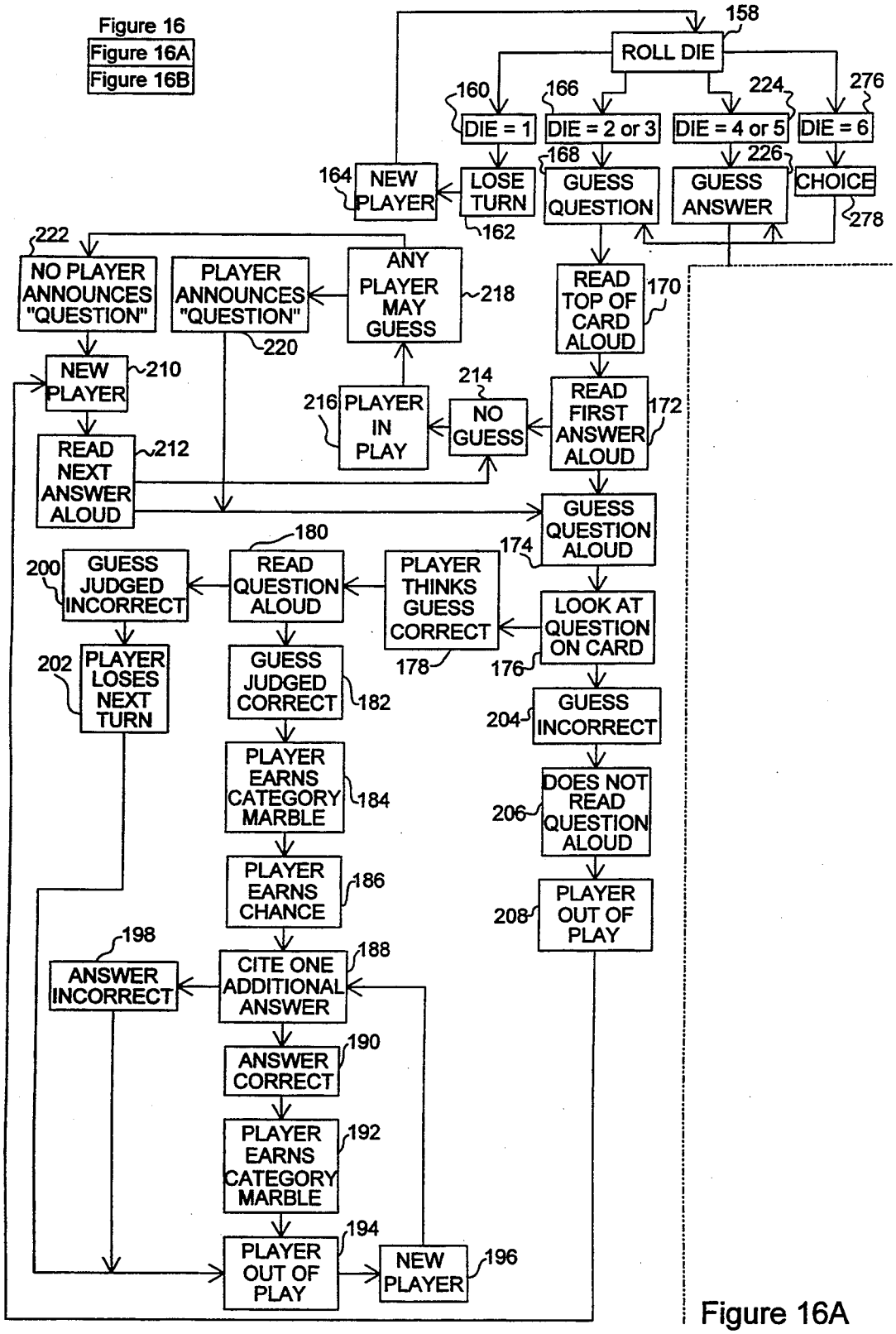
FIG. 16 is a block diagram showing the applicant's new and novel method.

Referring now to FIG. 16 of the drawings in general and in particular to FIG. 16A, once an initiating player has been determined, that player will then roll the at least one die again to determine the nature of a challenge to be met as shown in step 158. In the Preferred Embodiment, if the initiating player rolls a one, as in step 160, the initiating player loses a turn as shown in step 162 and the die is passed on to a new player positioned to the initiating player's left as shown in step 164. The new player then rolls the die to determine the nature of a challenge to be met for that round of play as shown in step 158.

If the initiating player rolls a two or a three as shown in step 166, the challenge to be met is "Guess Question" as shown in step 168. The initiating player then selects a category from which a challenge will be drawn. A player may select a category game card front any of the five categories but may not select an acronym card. The initiating player then draws the top card from the selected category and inserts the selected category game card in the card viewing device. place is passed to a new player to the left as shown in step 196.

If the initiating player's additional answer is incorrect as shown in step 198, the initiating player is out of play as shown in step 194 and the card viewing device with category game card is passed to a new player to the left as shown in step 196. In either case, the new player may then attempt to guess one additional answer as shown in step 188. The new player's answer guess is stated aloud and the new player then opens all of the movable elongated answer shielding members to determine whether the guessed answer is among the answers listed on the category game card. If the answer cited by the new player is a correct answer as shown in step 190, the new player earns category marble of the appropriate color as shown in step 192. The player is then out of play on this category game card as shown in step 194 and the card viewing device with category game card is passed to a new player on the left as shown in step 196 and that player attempts to guess a correct answer as described above. Play continues in the above described manner until all players have had the opportunity to guess an answer or until all correct answers as listed on the category game card have been given.

If the deciding player deems the initiating player's question guess is incorrect as shown in step 200, the initiating player loses his or her next turn as shown in step 202 and is out of play on the selected card as shown in step 194. The initiating player then passes the card viewing device containing the selected category game card to a new player positioned to the left of the initiating player as shown in step 196. The new player may then attempt to guess one additional answer to the now known question as shown in step 188. The new player's answer guess is stated aloud and the new player then opens all of the movable elongated answer shielding members to determine whether the guessed answer is among the answers listed on the category game card. If the answer cited by the new player is a correct answer as shown in step 190, the new player earns a category marble of the appropriate color The initiating player then reads aloud the exposed top of the category game card as shown in step 170. For example, the exposed top of the category game card may read "7 of 12, Life Styles". The initiating player then opens a first movable elongated answer shielding member to reveal a first answer which the initiating player reads aloud as shown in step 172. The initiating player now has the option of choosing to attempt to guess the question to the answer exposed or to pass.

If the initiating player chooses to guess the question, the initiating player guesses the question aloud as shown in step 174 and then looks at the question by opening the movable elongated question shielding member of the card viewing device to reveal a question on the game card as shown in step 176. The initiating player then determines if the guess is correct.

If the initiating player believes the guess is close enough to the question as stated on the game card to be judged correct as shown in step 178, the initiating player reads the question on the game card aloud as shown in step 180. The player to the right of the initiating player determines whether the guess is correct. If the deciding player deems the guess to be correct as shown in step 182, the initiating player earns a category marble of the color corresponding to the category game card played as shown in step 184. The initiating player then places category marble in a score indicating means receptacle on his or her marble tray.

The initiating player may also earn an additional score indicating means of the same color as shown in step 186 by citing aloud one more answer to the now known question as shown in step 188. The initiating player then opens the plurality of movable elongated answer shielding members to reveal the remaining answers on the category game card. If the cited answer is among the remaining answers as shown in step 190, the initiating player earns an additional category marble as shown in step 192. The initiating player is then out of play on this category game card as shown in step 194 and the card viewing device with the category card in as shown in step 192. The new player is then out of play on this category game card as shown in step 194 and the card viewing device with category game card is passed to a new player on his or her left as shown in step 196. The new player attempts to guess an additional correct answer as described above. Play continues in the above described manner until all players have had the opportunity to guess an answer or until all correct answers as listed on the category game card have been given.

If the new player's answer is incorrect as shown in step 198, no category marble is earned and the new player is out of play on the selected category game card as shown in step 194. The player then passes the card viewing device containing the category game card to a new player on his or her left as shown in step 196 and that player attempts to guess an additional correct answer as described above. Again, play continues in the above described manner until all players have had the opportunity to guess an answer or until all correct answers as listed on the category game card have been given.

If a player's answer is close but not identical to one of the listed answers on the category game card, the player to the current player's right determines whether the player's answer is close enough to be correct. Depending on the outcome of the deciding player's determination, play proceeds as described above.

If the initiating player determines his or her guess is incorrect as shown in step 204, the initiating player does not read the question aloud as shown in step 206. The initiating player is then out of play on this card as shown in step 208 and the card viewing device containing the selected category game card is passed to a new player to the left as shown in step 210. The new player then reads the next answer aloud as shown in step 212 and decides whether to guess the question. Play then proceeds as described above beginning again at step 174 or at step 214 which will be described more fully hereinafter.

If a player chooses to pass on the question, he or she announces "no guess" as shown in step 214. The player is still in play on the selected category game card as shown in step 216 and any other player may guess the question as shown in step 218.

If a player wishes to guess the question, that player will announce "question" as shown in step 220. In the situation where there is more than one player desirous of guessing the question, the first player to announce "question" will be the player who guesses the question. The new player guesses the question aloud as shown in step 174 and then looks at the question by opening the movable elongated question shielding member of the card viewing device to reveal the question on the game card as shown in step 176. The new player then determines if the guess is correct and play proceeds according to the rules described above.

If no player wishes to guess the question as shown in step 222, the current player passes the card viewing device containing the selected category game card to a new player on his or her left as shown in step 210. The new player then opens the movable elongated answer shielding member corresponding to the next available answer on the selected category game card. The revealed answer is read aloud as shown in step 212 and the new player decides whether to guess the question or pass following the rules of play as previously. Play continues in the before described manner until the question has been read aloud or all players have seen the question and had the opportunity to guess an answer. If only one player has not seen the question, that is, if all player pass but the last player, the last player may open all of the movable elongated answer shielding member before deciding whether to guess the question.

Figure 16B:
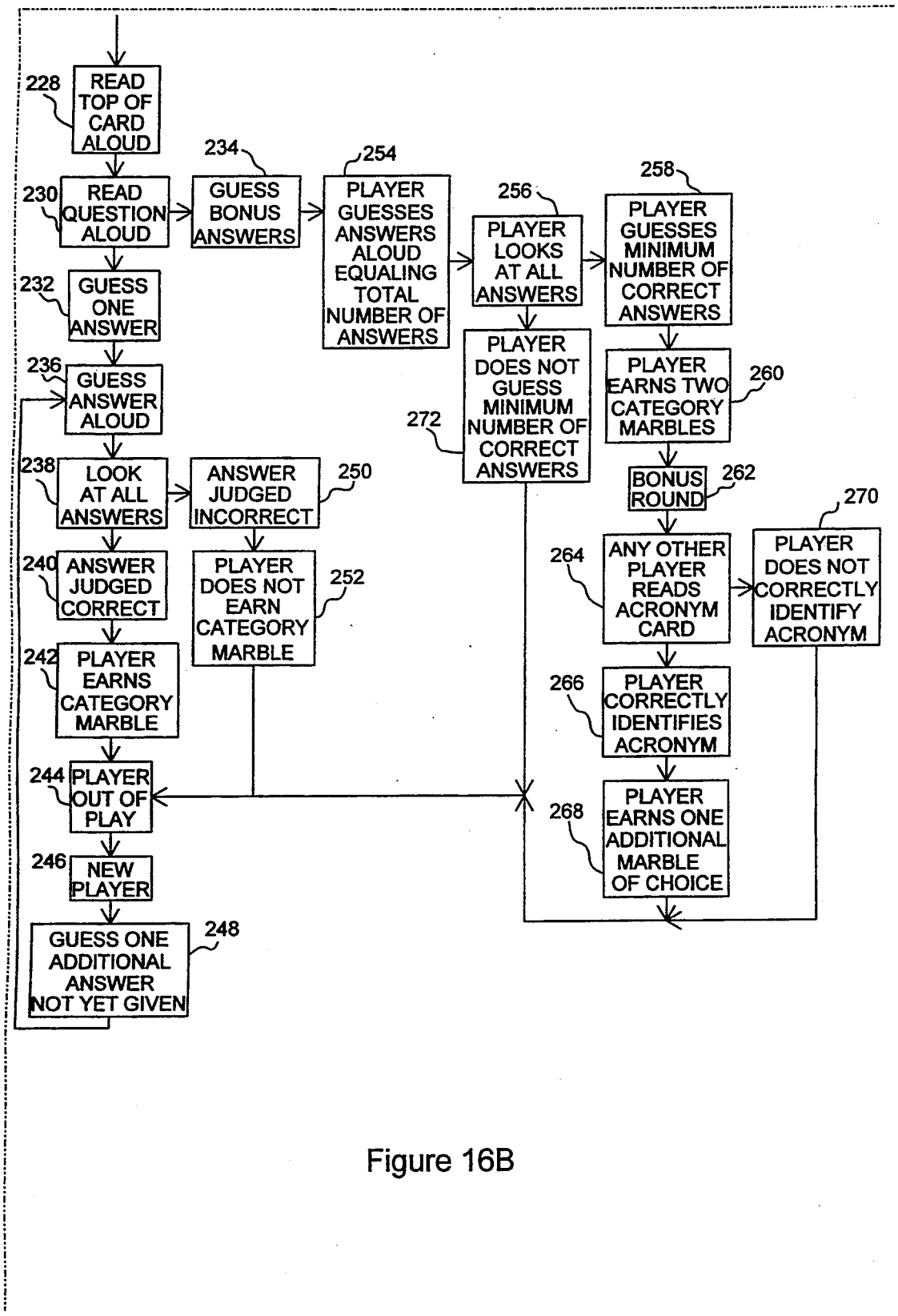

If the initiating player rolls a four or five on the die as shown in step 224, the challenge to be met is "Guess Answer" as shown in step 226. The initiating player then selects a category from which a challenge will be drawn, draws the top card from that category and places the selected category game card in the card viewing device as previously described. The initiating player reads the exposed portion of the category game card aloud as shown in step 228 of FIG. 16B of the drawings. For example, the exposed top of the category game card may read "7 of 12, Life Styles". Referring now to FIG. 16B of the drawings, the initiating player opens the movable elongated question shielding member and reads the question aloud as shown in step 230. The initiating player then decides whether to attempt to guess only one answer as shown in step 232 or a minimum number required to qualify for a bonus round as determined by the indicia on the exposed top of the category game card as shown in step 234. In the above example, "7 of 12, Life Styles", the player would guess twelve answers aloud, seven of which must be correct to enter the bonus round. The bonus will be discussed more fully hereinafter.

If the initiating player does not believe he or she knows the minimum number of answers to qualify for the bonus round, the initiating player attempts to guess only one answer as shown in step 232. The initiating player guesses an answer aloud as shown in step 236 and then opens all of the movable elongated answer shielding members to determine whether the guessed answer is correct as shown in step 238. If the answer is correct as shown in step 240, the initiating player earns a category marble of the appropriate color as shown in step 242. The initiating player is the out of play on this category game card as shown in step 244 and passes the card viewing device with the selected category game card to a new player to his or her left as shown in step 246. The new player may attempt to guess one additional answer not yet given as shown in step 248. The new player guesses an additional answer aloud as shown in step 236 and play proceeds as previously described.

If the initiating player's guess is incorrect as shown in step 250, the initiating player does not earn a category marble as shown in step 252 and is out of play on this category game card as shown in step 244. The initiating player passes the card viewing device with the selected category game card to a new player to his or her left as shown in step 246. The new player may attempt to guess one additional answer not yet given as shown in step 248.

If a player believes his or her answer is close but not identical to one of the listed answers on the category game card, the player to the right determines whether the answer is close enough to be correct. Depending on the outcome of the deciding player's determination, play proceeds as described above.

If the initiating player decides to guess the minimum number of answers to qualify for the bonus round as shown in step 234, the initiating player cites aloud a number of answers equaling a total number of possible answers as indicated on the top portion of the category game card as shown in step 254. A scratch pad and pencil are provided to record a plurality of cited answers. For example, if the selected category game card states "7 of 12, Life Styles", the initiating player would cite twelve answers, seven of which must be correct to win a chance for the bonus round. The initiating player then opens the movable elongated answer shielding members as shown in step 256 and states which of his or her answers were correct.

If the initiating player correctly guesses the minimum number of answers as shown in step 258, in the above example, seven, the initiating player earns two category marbles of the appropriate color as shown in step 260 and a chance at the bonus round as shown in step 262. In the bonus round, any other player selects the top game card from the acronym category and reads the acronym aloud as shown in step 264. If the initiating player correctly identifies what the selected acronym stands for as shown in step 266, the initiating player earns an additional marble of any color as shown in step 268. The player is now out of play on this card as shown in step 244 and the card viewing device with the selected category game card is passed to a new player to the left as shown in step 246. The new player may then guess one additional answer not yet given as shown in step 248. Play proceeds as previously described until all players have seen all of the answers or until all of the correct answers have been given.

If the initiating player cannot state the meaning of the acronym correctly as shown in step 270, the player is out of play on this card as shown in step 244 and the card viewing device with the selected category game card is passed to a new player to the left as shown in step 246. The new player may then guess one additional answer not yet given as shown in step 248. Play proceeds as previously described until all players have seen all of the answers or until all of the correct answers have been given.

If the initiating player does not correctly guess the minimum number of correct answers as required as shown in step 272, the initiating player is out of play on the selected category game card as shown in step 244 and the card viewing device with the category game card is passed to a new player to the initiating player's left as shown in step 246. The new player may guess an additional answer not yet given as shown in step 248 and play proceeds as previously described.

If the initiating player correctly guessed some but not all of the required minimum answers, those answers may not be given again by any other player.

If a player correctly guesses some of the minimum required answers and one or more of the answers cited by a player are close but not identical to the answers as listed on the selected category game card, the player to the right of the current player will determine whether the answers are close enough to be considered correct. Play then proceeds as described above.

Referring back now to FIG. 16A of the drawings, if the initiating player rolls a six on the at least one die as shown in step 276, the initiating player may choose to meet the "Guess Question" or the "Guess Answer" challenge as shown in step 278. After each round of play, the player to the left of the player initiating the previously completed round of play becomes the initiating player for the next round of play and play proceeds as described above.

Players may decide before a game session begins to invoke an Extra Challenge Alternative Play. Under these secondary rules, if the die roll is two or a three, thus placing the challenge in the Guess Question arena, play proceeds as follows:

The initiating player reads the exposed top of the category game card aloud as shown in step 170. The initiating player then opens the movable elongated answer shielding member corresponding to answer number one and cites answers aloud equal to the total number of answers as indicated on the top of the category game card, one of which is the answer on the category game card. For example, if the top of the category game card reads "7 of 12, Life Styles", and the first answer is "Snowdrop" the initiating player may cite "Daisy, Rose, Snowdrop, Dandelion, Turnip, Snapdragon, Asparagus, Petunia, Parsley, Poppy , Violet, and Tulip". The initiating player then decides whether to guess the question under the rules of regular play as before described. Thus, the Extra Challenge Alternative Play provides an additional technique by which the players may attempt to throw one another off the track and to block other players from earning the necessary category marbles to win the game session. That is, players will not know which one of the answers given is a correct answer as shown on the category game card.

A game session is won by the first player to earn two marbles of each color.

The following table summarizes the scoring:

| | |
|---|---|
| Question Correct: | One score indicating means of the selected category color plus chance to attempt one unread answer. |
| Answer Correct: | One score indicating means of the selected category color. |
| Bonus Answer Correct: | Two score indicating means of category color plus chance to guess acronym. |
| Acronym Correct: | One score indicating means of any color. |

From the above it can be seen that the applicant's new and novel game and method of play accomplishes all of the objects and advantages presented herein before. Nevertheless it is within the spirit and scope of the invention that changes in the applicant's basic game and method may be made and the Preferred Embodiment and the modifications shown and described herein have only been given by way of illustration.

Having described my invention, I claim:

1. A game for use by a plurality of players, the game providing a plurality of multi-dimensional challenges that test player knowledge and reasoning, a player responding to challenges in a pre-determined length of time, the game also providing components for game play, comprising:

a. a plurality of category game cards which include colored indicia, a portion of said colored indicia providing a category of challenge and another portion of said colored indicia providing a plurality of challenges, said colored indicia over-laid with a plurality of complementary colored masking characters, wherein a player response to said plurality of challenges given within a pre-determined length of time determines selective award and penalty;

b. at least one die, the at least one die having six sides, wherein each side of the at least one die has indicia thereon corresponding to a number, said at least one die employed by a player during game play, a number indicated by said indicia on said at least one die determining one of a plurality of challenges provided by said indicia on said plurality of category game cards a player responds to;

c. a card viewing device having a viewing side, an open end, and a plurality of movable elongated shielding members wherein said viewing side has a complementary colored transparent window member the complementary color of said complementary colored transparent window member matching the color of said plurality of complementary colored masking characters, said movable elongated shielding members movably covering said colored transparent window member when said movable elongated shielding members are in a closed position, wherein said colored indicia of said plurality of category game cards is visible through said colored transparent window member when one of said plurality of category game cards is inserted into said open end of said card viewing device and said movable elongated shielding members are moved from said closed position to an open position;

d. a plurality of acronym game cards which include indicia, a portion of said indicia providing a title and another portion of said indicia providing additional challenges, wherein said plurality of acronym game cards are provided as a bonus when a player response to a pre-determined challenge provided by said indicia on one of a plurality of category game cards is correct, wherein a player response to said additional challenges provided by said indicia on said plurality of acronym game cards determines selective award and penalty;

e. at least one timing device, said at least one timing device employed by a player wherein a player response to said plurality of challenges is given within a pre-determined length of time, the pre-determined length of time measured by said at least one timing device;

f. a plurality of score indicating means, said plurality of score indicating means provided as award when a player response to challenges is correct;

g. a plurality of score indicating means holding devices, said plurality of score indicating means holding devices employed by a plurality of players to hold a plurality of score indicating means when said plurality of score indicating means is provided as award; and h. a plurality of rules wherein a plurality of players are instructed in using said components for game play.

2. The game as defined in claim 1 wherein said colored indicia of said plurality of category game cards is black.

3. The game as defined in claim 2 wherein said colored transparent window member is clear.

4. The game as defined in claim 1 wherein said plurality of category game cards have a side and an opposite side, said side including colored indicia providing a category of challenge, said opposite side including colored indicia providing a plurality of challenges.

5. The game as defined in claim 1 wherein said plurality of acronym game cards have a side and an opposite side, said side providing a title of challenge, said opposite side providing challenge.

6. The game as defined in claim 1 wherein said plurality of score indicating means are spherical in shape.

7. The game as defined in claim 1 wherein said plurality of score indicating means holding devices have formed thereon a plurality of score indicating means receiving receptacles.

8. The game as defined in claim 7 wherein said plurality of score indicating means receiving receptacles are circular.

9. The game as defined in claim 1 further comprising a card viewing device wherein said plurality of category game cards are viewed with said card viewing device.

10. A card viewing device for use by a plurality of players playing a game, the card viewing device employed by a player to view a category game card to respond to a plurality of challenges provided by indicia on a plurality of category game cards that test player knowledge and reasoning, comprising:

a. a base member having an end and an opposite end, wherein said end of said base member has formed therein a plurality of holes, wherein a portion of said plurality of holes are adjacent to said end and positioned away from corners on said end and another portion of said plurality of holes are adjacent to said opposite end and positioned in close proximity to corners on said opposite end;

b. a U-shaped separating member having an end and an opposite end, wherein said end of said U-shaped separating member has formed therein a plurality of holes, wherein a portion of said plurality of holes are adjacent to said end and positioned away from corners on said end and another portion of said plurality of holes are adjacent to said opposite end and positioned in close proximity to corners on said opposite end, said U-shaped separating member being fixedly attached to said base member;

c. a transparent window member having an end and an opposite end, wherein said end of said transparent window member has formed therein a plurality of holes, wherein a portion of said plurality of holes are adjacent to said end and positioned away from corners on said end and another portion of said plurality of holes are adjacent to said opposite end and positioned in close proximity to corners on said opposite end, said transparent window member being fixedly attached to said U-shaped separating member;

d. a top member having an end, an opposite end, a hinge side and a bottom surface wherein said end of said top member has formed therein a plurality of holes, wherein a portion of said plurality of holes are adjacent to said end and positioned away from corners on said end and another portion of said plurality of holes are adjacent to said opposite end and positioned in close proximity to corners on said opposite end, said top member being fixedly attached to said transparent window member;

e. a plurality of movable elongated shielding members continuously formed on said hinge side of said top member; and f. a flexing means continuously formed in said bottom surface of said top member at a juncture of said movable elongated shielding means and said hinge side of said top member.

11. The card viewing device as defined in claim 10 wherein said portion of said plurality of holes of said U-shaped separating member align with said portion of said plurality of holes of said base member and said another portion of said plurality of holes of said U-shaped separating member align with said another portion of said plurality of holes of said base member.

12. The card viewing device as defined in claim 10 wherein said portion of said plurality of holes of said transparent window member align with said portion of said plurality of holes of said U-shaped separating member and said another portion of said plurality of holes of said transparent window member align with said another portion of said plurality of holes of said U-shaped separating member.

13. The card viewing device as defined in claim 10 wherein said portion of said plurality of holes of said top member align with said portion of said plurality of holes of said transparent window member and said another portion of said plurality of holes of said top member align with said another portion of said plurality of holes of said transparent window member.

14. The card viewing device as defined in claim 10 wherein said base member, said U-shaped separating member, said transparent window member and said top member form a layered configuration wherein said layered configuration produces an open end in said card viewing device, said open end being capable of receiving a category game card.

15. The card viewing device as defined in claim 10 wherein said base member, said U-shaped separating member, said transparent window member and said top member are fixedly attached by fastening means wherein said fastening means are a plurality of tee-nuts and a plurality of screws, said plurality of tee-nuts inserted into said plurality of holes and said plurality of screws securing said tee-nuts.

16. The card viewing device as defined in claim 10 wherein said transparent window member is transparently colored.

17. The card viewing device as defined in claim 10 wherein said transparent window member is clear.

18. The card viewing device as defined in claim 10 further comprising a method wherein said card viewing device is employed by a plurality of players to view a category game card to respond to a plurality of multi-dimensional challenges provided by indicia on said plurality of category game cards.

19. A method of playing a game for a plurality of players, the game providing a plurality of multi-dimensional challenges that test player knowledge and reasoning, a player responding to challenges in a pre-determined length of time, the game also providing components for game play, comprising:

a. providing a game having at least one die having a plurality of numbers thereon, no two numbers being alike, a plurality of category game cards having a top portion which bears indicia representing category challenge information which includes information as to a category to which a challenge belongs, a sub-category, a total number of possible answers and a minimum number of answers acceptable for a player to enter a bonus round, challenge information not in the top portion also provided by indicia includes a challenge question and indicia representing challenge answers, a card viewing device having a movable elongated question shielding member and plurality of movable elongated answer shielding members and a transparent window member, a plurality of acronym game cards having indicia thereon providing challenge information in the form of an acronym and related meaning, a plurality of colored score indicating means, each color corresponding to a challenge category a plurality of score indicating means holding devices and at least one timer, wherein the at least one timer is used to measure a pre-determined length of time in which a player responds to a challenge;

b. a plurality of players roll the at least one die to determine which player initiates the game playing session, where a player rolling the highest number becomes the initiating player for a game session;

c. an initiating player rolls the die to determine a challenge to respond to, the challenge determined by a number on the at least one die which is predetermined to correspond to a challenge, the challenge being to pass, guess a question, guess an answer or plurality of answers, or player choice to guess a question, guess an answer or plurality of answers;

d. an initiating player who must pass, as determined by the die roll in step c, passes the at least one die to a new player to the left who now becomes an initiating player and the player rolls the at least one die, the play repeating from step c with the new initiating player, to determine a challenge to respond to;

e. an initiating player who is to guess a question as determined by the die roll in step c, selects a category game card, inserts the category game card into the card viewing device and reads aloud indicia on the top portion of the category game card;

f. the initiating player opens a first movable elongated answer shielding member and reads aloud the now exposed answer which is visible through the transparent window of the card viewing device;

g. the initiating player may guess the question or pass;

h. an initiating player who chooses to guess the question makes a guess aloud and then opens the movable elongated question shielding member and looks at the question on the category game card to judge if the guess was correct;

i. an initiating player who correctly guesses the question earns a score indicating means of the appropriate color corresponding to the selected challenge category which is then placed into a score indicating means holding device and the initiating player also earns a chance to guess one of an additional plurality of answers still shielded by a plurality of movable elongated answer shielding members;

j. an initiating player who cams a chance to guess an additional answer, guesses the answer aloud and opens all of the remaining elongated answer shielding members to judge whether the guessed answer is correct;

k. an initiating player who correctly guesses an additional answer earns another score indicating means of the appropriate color corresponding to the selected challenge category is out of play on the selected category game card and passes the card viewing device with the selected category game card to a new player on the left who may guess one additional answer not yet given;

l. a new player who correctly guesses an additional answer proceeds as the initiating player in step k;

m. a player who incorrectly guesses an additional answer is out of play on the selected category game card and passes the card viewing device with the selected category game card to a new player on the left who may guess one additional answer not yet given proceeding as the initiating player in step k;

n. an initiating player who incorrectly guesses the question, as opposed to correctly guessing the question in step i, is out of play on the selected category game card and passes the card viewing device with the selected category game card to a new player on the left who opens a next movable elongated answer shielding member and reads aloud a now exposed next answer which is visible through the transparent window of the card viewing device, the game play now repeated as in steps g through m;

o. an initiating player who believes their guess question is close enough to the question on the category game card to be correct and then reads the question on the category game card aloud but their guess is judged incorrect by a player on the right loses their next turn and is out of play on the selected category game card and passes the card viewing device with the selected category game card to a new player on the left who may guess one additional answer to the now known question, the game play now repeated as in steps l through m;

p. an initiating player who chooses to not to guess the question, as provided in step g, remains in play on the selected category game card and any other player may become the initiating player and guess the question by announcing Guess Question and guessing the question aloud where play repeats from steps h through o;

q. when an initiating player chooses not to guess the question and no other player announces Guess Question, the card viewing device with the selected category game card is passed to a new player to the left who becomes the initiating player, the new initiating player reads a next answer aloud and decides whether to guess the question where play is repeated as in steps h through p, with the exception that when the player announcing Guess Question completes their turn, play reverts to the player whose turn it would have been had there been no intervening play;

r. an initiating player who is to guess an answer or plurality of answers as determined by the die roll in step c, selects a category game card, inserts the category game card into the card viewing device and reads aloud indicia on the top portion of the category game card, the indicia including information as to the category to which a challenge belongs, a sub-category, a total number of possible answers and a minimum number of answers acceptable for a player to enter a bonus round;

s. the initiating player opens the movable elongated question shielding member to reveal the question on the selected category game card, reads the question aloud and decides whether to guess one answer or try for the bonus round by guessing correctly the minimum number of acceptable answers as indicated by the indicia on the top portion of the selected category game card;

t. an initiating player who chooses to guess one answer makes the guess aloud, then looks at all of the answers on the selected category game card by opening the plurality of movable elongated answer shielding members and determines whether the guessed answer is correct;

u. an initiating player who correctly guesses one answer earns a score indicating means of the appropriate color corresponding to the challenge category, is out of play on the selected category game card and passes the card viewing device with the selected category game card to a new player on the left who guesses aloud one additional answer not yet given;

v. a new player who correctly guesses an additional answer earns a score indicating means of the appropriate color corresponding to the challenge category, is out of play on the selected category game card and passes the card viewing device with the selected category game card to a new player on the left who guesses aloud one additional answer not yet given, as in step u;

w. any player who incorrectly guesses one answer is out of play on the selected category game card and passes the card viewing device with the selected category game card to a new player on the left who guesses aloud one additional answer not yet given, the round of play continues repeating step v until all players have had an opportunity to guess an answer or until all answers have been given;

x. an initiating player who is to guess an answer or plurality of answers as determined by the die roll in step c, and who chooses to try for the bonus round by guessing correctly the minimum number of answers as indicated by the indicia on the top portion of the selected category game card, guesses aloud a number of answers equaling a total number of answers on the selected category game card as indicated by the indicia on the top portion of the selected category game card;

y. the initiating player then looks at all of the answers on the selected category game card by opening the plurality of movable elongated answer shielding members and judges whether a minimum number of the guessed answers are correct as indicated on the top portion of the selected category game card;

z. an initiating player who correctly guesses the minimum number of acceptable answers earns two score indicating means of the appropriate color corresponding to the selected challenge category and enters the bonus round where any other player selects an acronym game card from a plurality of acronym game cards and reads a challenge information in the form of an acronym;

aa. an initiating player who correctly identifies an acronym earns an additional score indicating means of any color, is out of play on the selected category game card and passes the card viewing device with the selected category game card to a new player on the left who may guess one additional answer not yet given, the game play now repeating as in steps l through m;

bb. an initiating player who incorrectly identifies an acronym is out of play on the selected category game card and passes the card viewing device with the selected category game card to a new player on the left who may guess one additional answer not yet given, the game play now repeating as in steps l through m;

cc. an initiating player who chooses to try for the bonus round by guessing correctly the minimum number of answers as indicated by the indicia on the top portion of the selected category game card and does not correctly guess the minimum number of answers as indicated by the indicia on the top portion of the selected category game card is out of play on the selected category game card and passes the card viewing device with the selected category game card to a new player on the left who may guess one additional answer not yet given, the game play now repeating as in steps l through m;

dd. an initiating player who may choose a challenge as determined by the die roll in step c, may choose to guess a question or guess an answer or plurality of answers, play proceeding as in steps e through cc; and ee. game play proceeds as in steps b through dd until one player has earned at least two score indicating means corresponding to each category of the plurality of category game cards provided.

20. The method as defined in claim 19 wherein a plurality of players agree, prior to game play, to invoke an Extra Challenge Play further comprising the steps:

ff. an initiating player who is to guess a question, as in step e, selects a category game card, inserts the category game card into the card viewing device and reads aloud indicia on the top portion of the category game card;

gg. the initiating player opens a first movable elongated answer shielding member and look at the answer which is visible through the transparent window of the card viewing device;

hh. the initiating player guesses aloud a number of answers equaling a total number of answers on the selected category game card as indicated by the indicia on the top portion of the selected category game card, the guessed answers including the exposed answer as provided in step gg;

ii. the initiating player then decides whether to guess the question or pass as provided in step g; and jj. play proceeding as provided in steps h through q.

* * * * *